US005520254A

United States Patent [19]

Weber

[11] Patent Number: 5,520,254

[45] Date of Patent: May 28, 1996

[54] FLUID-ACTUATED IMPACT HAMMER

[75] Inventor: Emil Weber, Kilchberg-Zürich, Switzerland

[73] Assignee: Günter Klemm, Germany

[21] Appl. No.: 360,044

[22] Filed: Dec. 20, 1994

[30] Foreign Application Priority Data

Dec. 21, 1993 [DE] Germany ..... 43 43 589.0

[51] Int. Cl.[6] ..... B25D 9/04; E21C 3/20

[52] U.S. Cl. ..... 173/128; 173/206; 173/207; 173/212

[58] Field of Search ..... 173/13, 91, 101, 173/128, 130, 131, 132, 133, 135, 136, 137, 138, 206, 207, 208, 210, 212

[56] References Cited

U.S. PATENT DOCUMENTS

| | | | |
|---|---|---|---|
| 4,006,665 | 2/1977 | Klemm | 91/278 |
| 4,109,734 | 8/1978 | Montabert | 173/212 X |
| 4,468,594 | 8/1984 | Jacquemet | 173/91 X |
| 4,871,035 | 10/1989 | Ekwall | 173/212 |
| 5,002,136 | 3/1991 | Barthomeuf | 173/128 X |
| 5,129,466 | 7/1992 | Bartels et al. | 173/138 X |
| 5,259,464 | 11/1993 | Bartels et al. | 173/91 |

FOREIGN PATENT DOCUMENTS 1038725 9/1978 Canada .

*Primary Examiner*—Scott A. Smith
*Assistant Examiner*—Jay A. Stelacone
*Attorney, Agent, or Firm*—Diller, Ramik & Wight

[57] ABSTRACT

The impact hammer comprises a working piston (22) which is displaceable within a working cylinder (21) and controlled by a control means (40,41) in such a manner that it exerts impacts onto an anvil surface (23) of an adapter (24) which can be connected to the object to be advanced. When retracting the object, a return impact piston (51) exerts impacts onto the adapter (24) in opposite direction. Thereby, it is achieved that the object can be better released from the drill hole.

9 Claims, 2 Drawing Sheets

FLUID-ACTUATED IMPACT HAMMER

BACKGROUND OF THE INVENTION

The invention relates to a fluid-actuated impact hammer for advancing objects in the ground, and particularly to an impact hammer by which a drill piping can be advanced into the ground.

From Canadian Patent 1 038 725 and U.S. Pat. No. 4,006,665, hydraulic impact hammers are known which comprise a working piston movable in a working cylinder. The working piston performs a working stroke at the end of which it strikes upon an anvil connected to the drill rods, and thereafter, it performs a return stroke. The working strokes and return strokes of the working piston are controlled by a control piston which, in turn, is controlled depending on the respective position of the working piston. Such impact hammers are suited for an effective advance of objects into the ground.

Difficulties do often arise when objects, as, e.g., drill pipes, are to be withdrawn from the ground. At the lower end of a drill pipe, there is a conical drill bit. Upon withdrawal of the drill piping, this drill bit gets stuck at the drill hole with a dowel effect. Commonly, the impact hammer is then actuated upon withdrawal to vibrate the drill rods and release the pipe.

From U.S. Pat. No. 5,259,464, an impact hammer for drill rods is known wherein the impact direction of the impact piston is reversible by reversing the impact hammer on the drill piping. This solution prerequires that the housing of the impact hammer is open at both ends. Considerable mounting efforts are required to reverse the impact hammer, and it can hardly be performed on the drilling site.

SUMMARY OF THE INVENTION

It is an object of the present invention to provide a fluid-actuated impact hammer which can be used for advancing objects into the ground as well as for withdrawing them without any conversion works being necessary.

Apart from the working piston, the drill hammer according to the invention comprises a counter impact hammer which acts upon the adapter and exerts counter impacts thereon. These counter impacts, of course, are only exerted when the working piston is either at a standstill or performs its return stroke. Accordingly, it is possible to continuously keep the counter impact piston in an active state or to configure it such that it can be switched off when the drill hammer is in operation. When exerting backward impacts, not only vibrations are generated but also backwardly directed impacts, whereby the release of the object to be withdrawn is facilitated.

Particularly, the invention is applicable in case of drilling with rotating drill rods, but it is also suitable for advancing and withdrawing other objects, e.g. sheet piles. Preferably, the impact hammer is arranged at the rearward end of a drill piping in the form of an external hammer, but it can also be configured as an in-hole hammer which is arranged in the course of a drill piping near the drill bit.

BRIEF DESCRIPTION OF THE DRAWINGS

Hereinafter, embodiments of the invention are explained in detail with reference to the drawings, in which.

DESCRIPTION OF THE PREFERRED EMBODIMENTS

Figure 1:
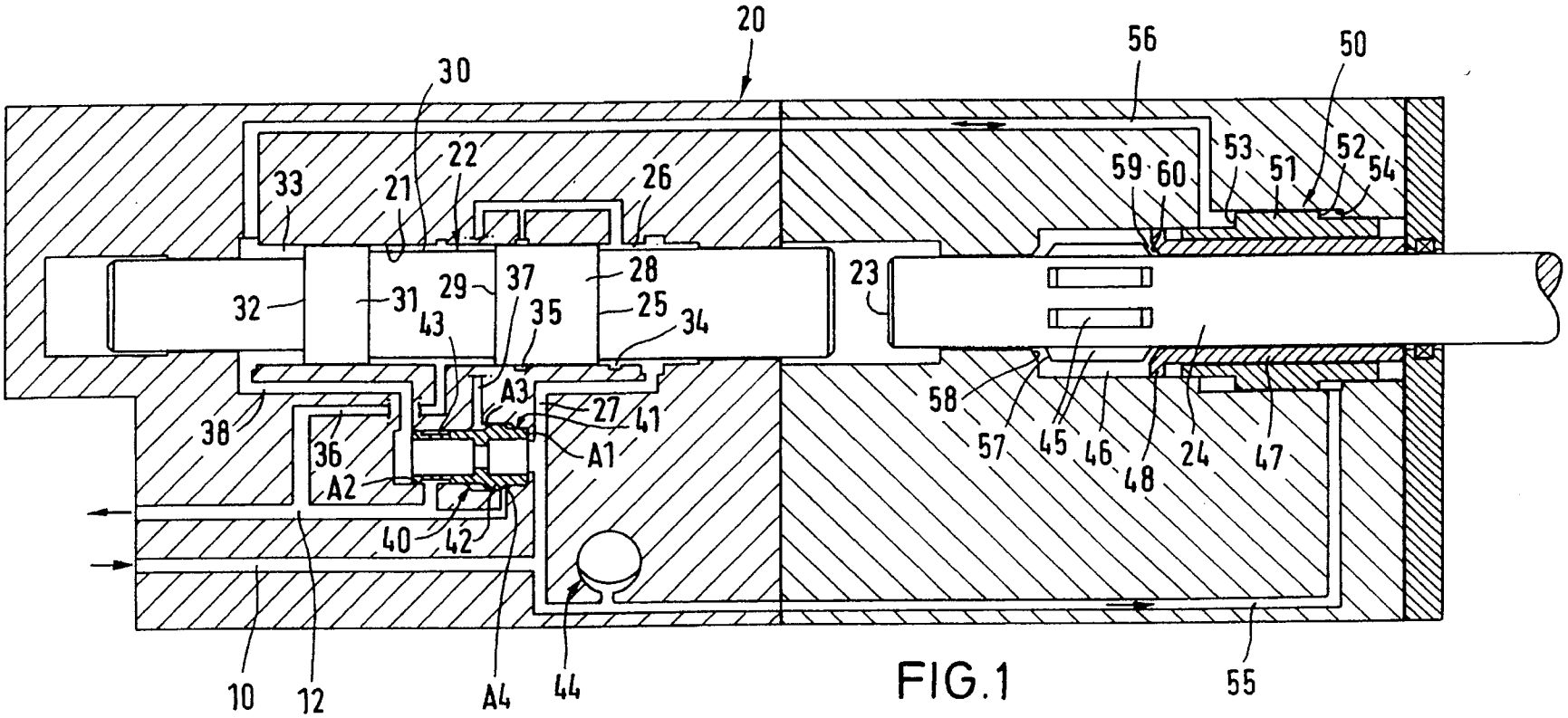
FIG. 1 shows a schematic longitudinal sectional view of a first embodiment of the impact hammer, wherein the return impact piston exerts impacts offset in time with respect to the working piston.

The drill hammer shown in FIG. 1 comprises a hammer housing 20 containing a working cylinder 21. The working piston 22 is guided in the working cylinder 21. The front end of the working piston 22 exerts impacts onto an anvil surface 23 of an adapter 24 which is guided so as to be longitudinally displaceable within certain limits. The adapter 24 is a plug-in member which projects from the hammer housing 20 and to which drill rods can be mounted.

"Front" respectively means the direction pointing toward the drill piping, and "back" the opposite direction.

The working piston 22 comprises a forwardly directed annular working surface 25 limiting the annular front cylinder chamber 26. This cylinder chamber 26 is continuously connected to a pressure conduit 10 via a conduit 27. The working surface 25 limits an enlarged section 28 of the working piston. The other delimitation of the section 28 is formed by a working surface 29 followed by a thinner section 30. Behind the thinner section 30, there is another thicker section 31 whose rearward end is formed by a working surface 32. The working surface 32 delimits the rearward cylinder chamber 33 of the working cylinder 21. The working surface 32 is larger than the working surface 25.

The working surface 25 moves along a control groove 34 in the front cylinder chamber 26. The working surface 29 moves along a control groove 35. In the region of the thinner section 30 of the working piston, a conduit 36 connected to the return conduit 12 opens into the working cylinder 21. Control grooves 34 and 35 are connected to a control conduit 37. The rearward cylinder chamber 33 of the working cylinder is connected to an operation conduit 38.

The working piston 22 is controlled by the control piston 41 which is movable in the control cylinder 40. The control piston 41 is configured as hollow sleeve. Since the control cylinder 40 is connected to the pressure conduit 27, always the full hydraulic pressure prevails in the interior of the control piston 41. At one end, the control piston 41 comprises a first working surface A1 which is continuously subject to the pressure and comprises radial grooves so that the pressure can act upon it. At the opposed end of the working piston, there is a second working surface A1 which is smaller than the working surface A1. The control piston is provided with an annular collar 42 which, on one end, is limited by a control surface A3, and, at the opposed end, by an always pressureless surface A4 which is connected to the return conduit 12. The control surface A3 is subject to the pressure of the control conduit 37. Further, the control piston 41 is provided with an annular groove 43 which, in any position of the working piston, communicates with the return conduit 12. The pressure conduit 27 is connected to a pressure gas reservoir 44 which acts as a buffer for smoothing the hydraulic impact strokes.

The impact apparatus described so far operates as follows:

In the state shown in FIG. 1, the operation conduit 38 is connected to the pressure conduit 27 via the interior of the control piston 41, so that the full pressure acts upon the working surface 32. Since the working surface 32 is larger than the working surface 25 onto which the full pressure is applied as well, the working piston 22 performs its forwardly directed working stroke at the end of which it strikes upon the anvil surface 23. As soon as the control surface 25 has passed the control groove 34, the control conduit 37 is separated from the pressure conduit 27. After the control surface 29 has passed the control groove 35, the control conduit 37 is connected to the conduit 36 via the groove 35 and thus becomes pressureless. Thus, no pressure acts upon the control surface A3 of the control piston 41. The control piston is moved back because the force exerted upon the working surface A1 exceeds the force being exerted by the same pressure upon the working surface A2. When the control piston has reached its upper end position, the operation conduit 38 is separated from the supply pressure and connected to the return conduit 12 via the annular groove 43. Thereby, the return stroke of the working piston 22 is effected. As soon as the groove 35 is blocked by the enlarged piston portion 28, and the groove 34 is released from the working surface 25, the full pressure develops in the control conduit 27, which acts upon the control surface A3 and drives the control piston into the lower end position. The sum of the working surface A2 and the control surface A3 is greater than the working surface A1.

The hammer housing 20 is pressed forwardly to advance the drill piping. The drill piping is supported on the drill hole sole so that the adapter 24 is pressed into the hammer housing 20. This axial movement of the adapter 24 is limited by the splining 45 of the adapter 24. This splining is movable, within certain limits, in a cavity 46 of the hammer housing 20. A rotational drive (not shown) for rotating the adapter 24 and thus the drill piping engages into the keyways. Upon advancing the hammer housing 20, the adapter 24 is in its rearward end position in which the working piston 22 exerts impacts upon the anvil surface 23. Upon each impact, the adapter 24 can move within the free space defined by the cavity 46. If, however, the hammer housing 20 is retracted, the splining 45 assumes its front end position within the cavity 46. This front end position is limited by a spacer 47 which is configured as tube sleeve and surrounds the adapter 24. The spacer 47 is supported on the front end face of the hammer housing 20 and its rearward end 48 serves as supporting shoulder to limit the advance movement of the adapter 24.

The spacer 47 is surrounded by the return impact piston 50 which slides along the sleeve. The return impact piston 50 comprises a section 51 of enlarged outer diameter. The section 51 is limited by a working surface 52 opposite which a control surface 53 is located. The return impact piston 50 is displaceable within a return impact cylinder 54 of the hammer housing 20. The front cylinder chamber limited by the working surface 52 is connected to the pressure conduit 10 via a conduit 55 and thus always subject to the full pressure. The rearward cylinder chamber which is limited by the control surface 53 is connected to the cylinder chamber 33 of the working cylinder or to the operation conduit 38 via a control conduit 56. The cross-sectional area of the control surface 53 is larger than that of the working surface 52. During the return stroke of the working cylinder 22, the rearward cylinder chamber 33 of the working cylinder is pressureless, so that also the rearward control surface 53 of the return impact piston 50 becomes pressureless and the return stroke piston strikes onto the flange at the rearward end 48 of the sleeve-shaped spacer 47.

The return impact piston 50 is controlled together with the working piston 22 by the control means 40,41 in the described manner. The control of both pistons is effected with a phase shift of 180°. This means that the return impact piston 50 exerts its impact while the working piston 22 performs its return stroke. Thereby, it is avoided that the impacts of the return impact piston diminuish the impact energy of the working piston. Further, it is to be considered that upon advance of the drill piping mounted to the adapter 24, an advance force acts upon the hammer housing 20, so that the rearward stop surface 57 of the splining 45 abuts on a forwardly directed limiting surface 58 of the cavity 46 so that the spacer 47, onto the end 48 of which the return impact piston 50 exerts an impact, has an axial movement clearance. Thereby, it is avoided that the impacts of the return impact piston 50 have an effect upon the adapter 24 and the drill piping upon advance.

When retracting the hammer housing 20, however, the front counter impact surface 59 of the splining 45 abuts on the rearward end face 60 of the spacer 47. The impacts of the return stroke piston 50 are transferred onto the counter impact surface 59 of the adapter 24 via the rearward end 48 of the spacer. The working piston 22 is also in operation when the hammer housing 20 is retracted. Then, however, the impacts of the working piston do not reach, or reach, with only little energy, the anvil surface 23 of the adapter 24, because the adapter is in the advanced position in the hammer housing.

In summary, it is to be noted that the working piston 22 and the return impact piston 50 are always both simultaneously in operation, but that upon advance, only the impacts of the working piston 22 are transferred to the adapter 24, and that, upon retracting of the hammer housing, only the impacts of the return impact piston 50 are transferred to the adapter 24.

Figure 2:
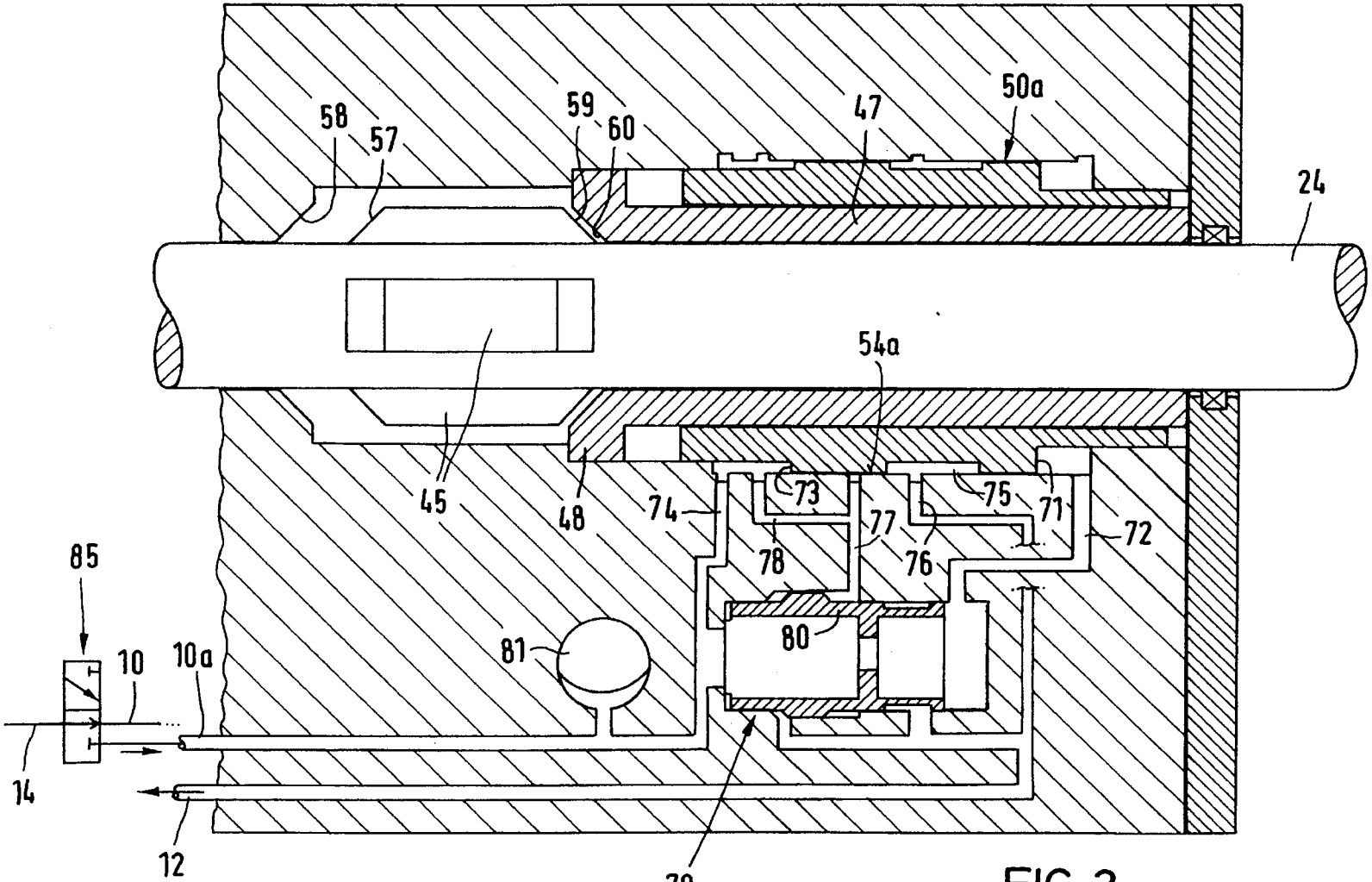
FIG. 2 shows a modified embodiment, wherein the return impact piston is controlled by a control means of its own.

To a great extent, the embodiment of FIG. 2 is similar to that of FIG. 1, the working piston and the control means for the working piston not being shown in FIG. 2. A difference is that the return impact piston **50*a* has a control means 70 of its own in FIG. 2, which is independent of the control means 40, 41** of the working piston.

The return impact piston **50*a* is provided with a forwardly directed control edge 71, onto which the pressure of an operation conduit 72 acts. Further, the return impact piston is provided with a backwardly directed working edge 73 which is subject to the pressure of a conduit 74 which is connected to a pressure conduit 10*a*. Further, the return impact piston 50*a* comprises an elongated circumferential groove 75 which is, in any position of the return impact piston, in the region of a conduit 76 connected to the return conduit 12. Further, a control conduit 77 leads from the return impact cylinder 54*a* to the control means 70. A branch conduit 78 leads from the conduit 77 into the return impact cylinder 54*a* near the conduit 74**.

The cross-sectional area of the control surface 71 is greater than that of the working surface 73 which is continuously subject to high pressure. When the conduit 72 becomes pressureless, the return impact piston **50*a* moves forwardly. Conduit 77 is separated from the groove 75 and the return conduit 76, while the branch conduit 78 is pressurized. The pressure in the control conduit 77 leads the control piston 80 into that position in which the operation conduit 72 is pressurized. Thereby, the return impact piston is accelerated to strike upon the end 48 of the spacer 47, and this impact is transferred to the counter impact surface 59 of the adapter 24. When the return impact piston 50*a* reaches its rearward end position, the groove 75 connects the conduit 77 with the pressureless conduit 76**, and the branch conduit 78 is blocked. Thereby, the control conduit 77 becomes pressureless and the control piston 80 is displaced into that position in which it connects the operation conduit 72 to the return conduit 12.

The return impact piston 50*a* does not only have its own control means 70 but also its own pressure gas reservoir 81 which is connected to the pressure conduit 10*a*.

According to FIG. 2, a switching device 85 in the form of an on-off valve is provided which connects a pressure conduit 14 coming from a pressure source either to the pressure conduit 10 leading into the working cylinder 21 or to the pressure conduit 10*a* leading into the return impact cylinder 54*a*. Consequently, only the working piston 22 is actuated, while the return impact piston 50*a* is switched off. When the switching device 85 is switched into the other position, the working piston 22 is inactive and the return impact piston 50*a* is actuated. Advantageously, the switching device 85 is actuated depending on the movement of the advance device which either advances or retracts the hammer housing 20. When the advance device is switched so as to advance, then the switching device 85 is automatically switched into the position shown in FIG. 2, and when the advance device is switched so as to retract, then the switching device 85 is switched so that it connects the pressure conduit 10*a* to conduit 14.

What is claimed is:

1. A fluid-actuated impact hammer for driving an object into the ground comprising a hammer housing (20) defining a working cylinder (21), a working piston (22) reciprocally slidable within said working cylinder (21), an adapter (24) in substantially aligned relationship to said working piston, said adapter (24) having an anvil surface (23) facing in a first direction opposing said working piston (22), said adapter (24) being adapted to be connected to an object which is to be advanced upon movement of said working piston (22) in a working direction opposite to said first direction, control means (40, 41) for selectively introducing pressurized fluid into said working cylinder (21) for reciprocating said working piston (22) between said working direction and an opposite return direction, said adapter (24) having a counter impact surface (59) facing in a second direction opposite to said first direction, and a return impact piston (50; 50*a*) for selectively impacting against said counter impact surface (59) to move said adapter (24) in a direction opposite to said working direction.

2. The fluid-actuated impact hammer as defined in claim 1 wherein said adapter (24) is guided in said hammer housing (20), spacer means (47) for limiting the movement of said adapter (24) in one of said first and second directions, and said return impact piston (50; 50*a*) is an annular piston surrounding said adapter (24) and said spacer (47).

3. The fluid-actuated impact hammer as defined in claim 1 wherein said adapter (24) is guided in said hammer housing (20), spacer means (47) for limiting the movement of said adapter (24) in one of said first and second directions, said return impact piston (50; 50*a*) is an annular piston surrounding said adapter (24) and said spacer (47), and said spacer (47) is an annular spacer surrounding said adapter (24).

4. The fluid-actuated impact hammer as defined in claim 1 wherein said adapter (24) is guided in said hammer housing (20), spacer means (47) for limiting the movement of said adapter (24) in one of said first and second directions, said return impact piston (50; 50*a*) is an annular piston surrounding said adapter (24) and said spacer (47), said spacer (47) is an annular spacer surrounding said adapter (24), and being itself surrounded by said annular impact piston (50; 50*a*).

5. The fluid-actuated impact hammer as defined in claim 1 wherein said adapter (24) is guided in said hammer housing (20), spacer means (47) for limiting the movement of said adapter (24) in one of said first and second directions, said return impact piston (50; 50*a*) is an annular piston surrounding said adapter (24) and said spacer (47), and said spacer (47) includes a flange (48) disposed between an axial end face of said return impact piston (50; 50*a*) and said counter impact surface (59).

6. The fluid-actuated impact hammer as defined in claim 1 wherein said control means (40, 41) is also constructed and arranged for selectively controlling the movement of said return impact piston (50).

7. The fluid-actuated impact hammer as defined in claim 1 including further control means (70) for selectively controlling the movement of said return impact piston (50).

8. The fluid-actuated impact hammer as defined in claim 1 including further control means (70) for selectively controlling the movement of said return impact piston (50), and switching means (85) for selectively activating one of said first-mentioned and further control means (40, 41; 70).

9. The fluid-actuated impact hammer as defined in claim 1 wherein said counter impact surface (59) is defined by spline (45) carried by said adapter (24).

* * * * *